US006880352B2

(12) United States Patent
Yamasaki et al.

(10) Patent No.: US 6,880,352 B2
(45) **Date of Patent: *Apr. 19, 2005**

(54) HEAT PUMP DEVICE

(75) Inventors: Haruhisa Yamasaki, Gunma (JP); Hiroshi Mukaiyama, Gunma (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/380,161

(22) PCT Filed: Jul. 2, 2002

(86) PCT No.: PCT/JP02/06685

§ 371 (c)(1),
(2), (4) Date: Mar. 18, 2003

(87) PCT Pub. No.: WO03/004948

PCT Pub. Date: Jan. 16, 2003

(65) Prior Publication Data

US 2003/0188544 A1 Oct. 9, 2003

(30) Foreign Application Priority Data

Jul. 2, 2001 (JP) ..... 2001-200412

(51) Int. Cl.[7] ..... F25B 27/00; F25B 47/00
(52) U.S. Cl. ..... 62/238.1; 62/278
(58) Field of Search ..... 62/238.1, 238.6, 62/278, 160, 498, 510, 196.2; 418/11, 249

(56) References Cited

U.S. PATENT DOCUMENTS 3,869,874 A * 3/1975 Ditzler ..... 62/278
5,570,585 A * 11/1996 Vaynberg ..... 62/175
6,085,544 A * 7/2000 Sonnekalb et al. ..... 62/498
6,112,547 A * 9/2000 Spauschus et al. ..... 62/476

FOREIGN PATENT DOCUMENTS

| | | |
|---|---|---|
| JP | 52-164737 | 12/1977 |
| JP | 55-10961 | 1/1980 |
| JP | 64-53868 | 4/1989 |
| JP | 2-8660 | 1/1990 |
| JP | 2-13765 | 1/1990 |
| JP | 7-218053 | 8/1995 |
| JP | 11-294906 | 10/1999 |
| JP | 2000-171108 | 6/2000 |
| JP | 2001-56159 | 2/2001 |
| JP | 2002-106963 | 4/2002 |

* cited by examiner

*Primary Examiner*—Chen Wen Jiang
(74) *Attorney, Agent, or Firm*—Armstrong, Kratz, Quintos, Hanson & Brooks, LLP

(57) ABSTRACT

In a heat pump apparatus having a refrigerating cycle including a compressor 1, a gas cooler 3, a pressure reducing device 5 and an evaporator 7 in which water can be heated by the gas cooler, the compressor 1 comprises a two-stage compression type compressor for leading all or a part of refrigerant compressed to an intermediate pressure at a first stage through a shell case 11 to a second stage, compressing the intermediate-pressure refrigerant to a high pressure at a second stage and discharging the high-pressure refrigerant, and there is equipped a defrosting circuit 33 for leading the intermediate-pressure refrigerant of the first stage of the compressor 1 to the evaporator 7 with bypassing the gas cooler 3 and the pressure reducing device 5.

10 Claims, 4 Drawing Sheets

HEAT PUMP DEVICE

TECHNICAL FIELD

The present invention relates to a heat pump apparatus using a two-stage compression type compressor.

BACKGROUND ART

There is known a heat pump type hot water supply apparatus that generally has a refrigerating cycle including a compressor, a gas cooler, a pressure reducing device and an evaporator and is designed to supply water heated by the gas cooler.

This type of apparatus has hitherto used freon containing chlorine (HCFC22 or the like) as refrigerant in a refrigerating cycle. However, from the viewpoint of ozone layer protection, restriction of use of freon has been promoted. Even in the case of freon containing no chlorine (HFC) as substitute refrigerant, it has been specified as a restriction target material in Kyoto Conference on Global Warming (COP3) because it has a high global warming potential.

Therefore, a motion of using materials existing in the natural world in place of synthetic material such as freon as refrigerant in the refrigerating cycle has been promoted, and particularly use of $CO_2$ refrigerant in the refrigerating cycle has been promoted to be considered.

When $CO_2$ refrigerant is used, a transcritical cycle in which the high-pressure side of the refrigerating cycle is transformed into a supercritical state is established, and thus it is expected that a high coefficient of performance (COP) can be achieved in a heating process having a large water-temperature rise-up range as in the case of hot water supply by a heat pump type hot water supply apparatus.

However, at the same time, the refrigerant must be compressed to a high pressure, so that an internal intermediate pressure two-stage compression type compressor has been recently used.

In this type of apparatus, devices constituting the refrigerating cycle are frequently disposed as a heat pump unit outdoors, and for example in a winter season or the like, it is frequently required to carry out the defrosting operation on an evaporator.

In this case, it is general to perform a hot gas defrosting operation in which refrigerant discharged from the compressor is supplied to the evaporator with bypassing the gas cooler and the pressure reducing device so that the evaporator is heated with the heat of the refrigerant to be defrosted. However, any defrosting circuit to be used when a two-stage compression type compressor is used has not yet been proposed.

Therefore, an object of the present invention is to solve the problem of the prior art and provide a heat pump apparatus which can perform a defrosting operation efficiently when a two-stage compression type compressor is used.

DISCLOSURE OF THE INVENTION

According to the present invention, a heat pump apparatus having a refrigerating cycle including a compressor, a gas cooler, a pressure reducing device and an evaporator in which water can be heated by the gas cooler, is characterized in that the compressor comprises a two-stage compression type compressor for leading all or a part of refrigerant compressed to an intermediate pressure at a first stage through a shell case to a second stage, compressing the intermediate-pressure refrigerant to a high pressure at a second stage and discharging the high-pressure refrigerant, and the heat pump apparatus includes a defrosting circuit for leading the intermediate-pressure refrigerant of the first stage of the compressor to the evaporator with bypassing the gas cooler and the pressure reducing device.

According to the present invention, the heat pump apparatus as described may be characterized by further including a high-pressure defrosting circuit for leading the high-pressure refrigerant of the second stage of the compressor to the evaporator with bypassing the gas cooler and the pressure reducing device.

According to the present invention, the heat pump apparatus as described may also be characterized in that refrigerant which works in a supercritical area at a high-pressure side is charged and used in the refrigerating cycle.

According to the present invention, the heat pump apparatus as described may further be characterized in that the refrigerant is $CO_2$ refrigerant.

According to the present invention, the heat pump apparatus as described may still further be characterized in that the defrosting circuit is equipped with an opening/closing valve with which the inside of the shell case of the compressor can be vacuum-evacuated.

According to the present invention, the heat pump apparatus described may vet further be characterized in that the mixing ratio of oil in the intermediate-pressure refrigerant of the first stage is smaller than the mixing ratio of oil in the high-pressure refrigerant of the second stage.

According to the present invention, a heat pump apparatus having a refrigerating cycle including a compressor, a gas cooler, a pressure reducing device and an evaporator in which water can be heated by the gas cooler, is characterized in that refrigerant that works in a supercritical area at a high pressure side is filled and used in the refrigerating cycle, the compressor comprises a two-stage compression type compressor for leading all or a part of refrigerant compressed to an intermediate pressure at a first stage through the shell case to a second stage, compressing the intermediate-pressure refrigerant to a high pressure at the second stage and discharging the high-pressure refrigerant, and the heat pump apparatus is equipped with a defrosting circuit for leading the intermediate-pressure refrigerant of the first stage of the compressor and/or the high-pressure refrigerant of the second stage to the evaporator with bypassing the gas cooler and the pressure reducing device.

According to the present invention employing a refrigerant that works in a supercritical area at a high pressure side in the refrigerating cycle, the heat pump apparatus may be characterized in that the refrigerant is $CO_2$ refrigerant.

According to the present invention, the heat pump apparatus employing a refrigerant that works in a supercritical area at a high pressure side in the refrigerating cycle may also be characterized in that the defrosting circuit is equipped with an opening/closing valve with which the inside of the shell case of the compressor can be vacuum-evacuated.

According to the present invention, the heat pump apparatus employing a refrigerant that works in a supercritical area at a high pressure side in the refrigerating cycle as may further be characterized in that the mixing ratio of oil in the intermediate-pressure refrigerant of the first stage is smaller than the mixing ratio of oil in the high-pressure refrigerant of the second stage.

BEST MODES FOR CARRYING OUT THE INVENTION

Embodiments according to the present invention will be described with reference to the drawings.

Figure 1:
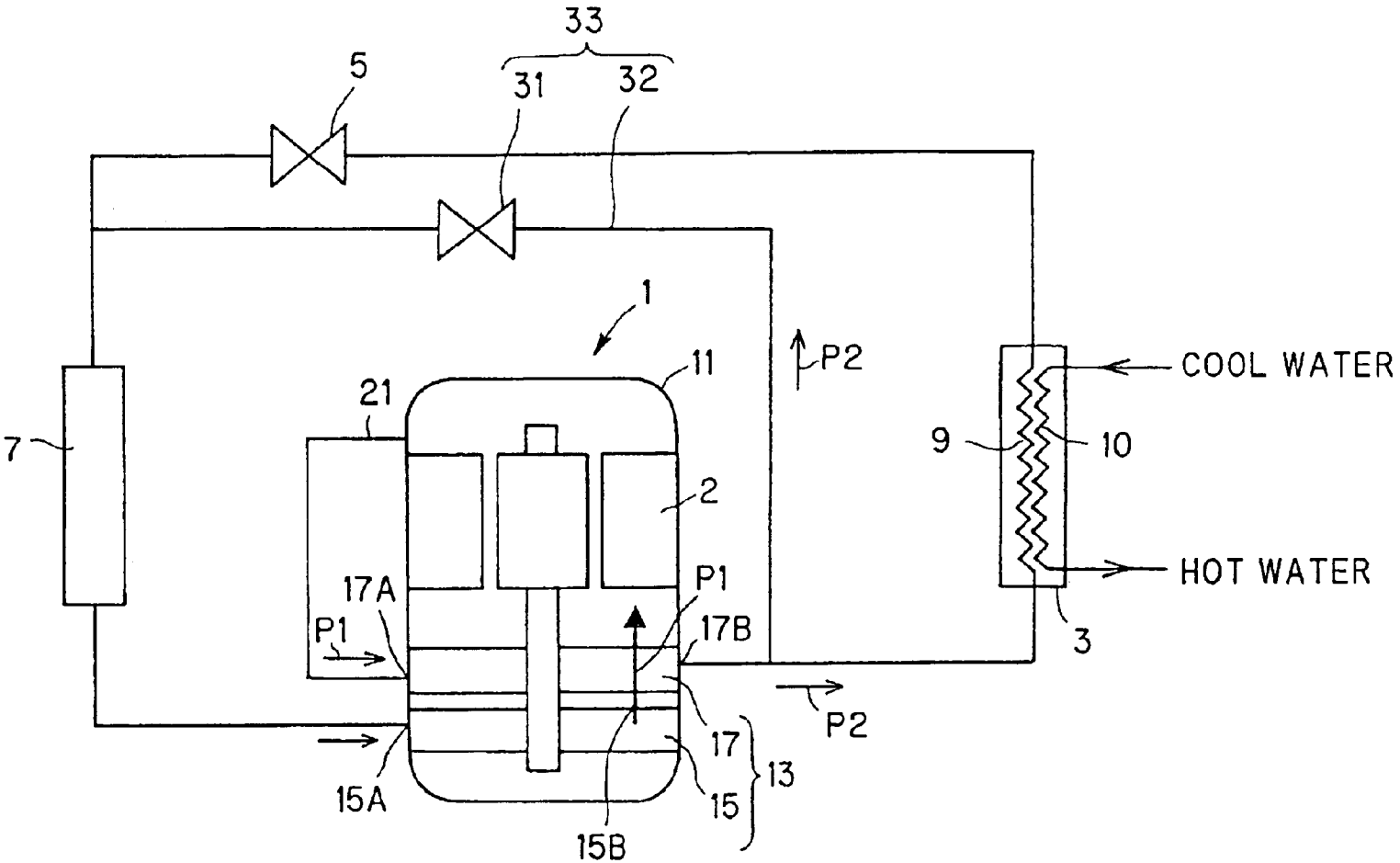
FIG. 1 is a circuit diagram showing an embodiment of a heat pump apparatus according to the present invention.

FIG. 1 shows a heat pump apparatus using a two-stage compression type rotary compressor. Reference numeral 1 represents a compressor. To the compressor 1 are connected a gas cooler (high-pressure side heat exchanger) 3, a pressure reducing device (expansion valve) 5 and an evaporator (low-pressure side heat exchanger) 7 in this order, thereby constituting a refrigerating cycle.

The refrigerating cycle uses $CO_2$ refrigerant. The $CO_2$ refrigerant has an ozone depletion coefficient of zero and a global warming potential of 1. Therefore, it has a low load on the environment, has no toxicity and no flammability, and is safe and low in price. When $CO_2$ refrigerant is used, a transcritical cycle in which the high-pressure side of the refrigerating cycle is transformed into a supercritical state is established, and thus it is expected that a high coefficient of performance is achieved in a heating processing having a large water-temperature rise-up range as in the case of hot water supply in a heat pump type hot water supply apparatus.

However, at the same time, the refrigerant must be compressed to a high pressure, and thus an internal intermediate pressure two-stage compression type compressor is used as the compressor 1.

The internal intermediate pressure two-stage compression type compressor 1 has an electric motor portion 2 and a compressing portion 13 driven by the electric motor portion 2, which are mounted in a shell case 11. The compressing portion 13 has a two-stage compressing structure, and it comprises a first-stage compressing portion 15 and a second-stage compressing portion 17.

Refrigerant sucked from the suction port 15A of the first-stage compressing portion 15 is compressed to an intermediate pressure P1 in the compressing portion 15, and then all the refrigerant thus compressed is temporarily discharged from the discharge port 15B into the shell case 11. After passing through the shell case 11, the refrigerant is passed through a pipe path 21, led to the suction port 17A of the second-stage compressing portion 17, compressed to a high pressure P2 in the second-stage compressing portion 17, and then discharged from the discharge port 17B.

The gas cooler 3 comprises a refrigerant coil 9 through which $CO_2$ refrigerant flows, and a water coil 10 through which water flows, and the water coil 10 is connected through a water pipe to a hot water reservoir tank (not shown). A circulating pump omitted from the illustration is connected to the water pipe, and water in the hot water reservoir tank is circulated in the gas cooler 3 by driving the circulating pump. The water is heated in the gas cooler 3, and then stocked in the hot water reservoir tank.

The heat pump apparatus is disposed as a heat pump unit outdoors, and thus it is necessary to remove frost attached to the evaporator 7.

Therefore, according to this embodiment, a hot gas defrosting circuit 33 containing a defrosting electromagnetic valve 31 and a bypass pipe 32 is equipped to lead the high-pressure P2 refrigerant of the second stage 17 of the compressor 1 to the evaporator 7 with bypassing the gas cooler 3 and the pressure reducing device 5. Under the hot gas defrosting operation, the normally-closed defrosting electromagnetic valve 31 equipped in the bypass pipe 32 is opened.

When this defrosting operation is carried out, the high-pressure refrigerant of the compressor 1 is fed to the evaporator 7 to heat the evaporator 7, thereby removing frost attached to the evaporator.

This embodiment can perform the efficient defrosting operation when the internal intermediate pressure two-stage compression type compressor 1 is used.

Furthermore, since the high-pressure P2 refrigerant is fed to the gas cooler 3 while carrying out the defrosting operation, reduction of the temperature of the gas cooler 3 during the defrosting operation can be suppressed, thereby shortening the time until a steady operation is established when a normal operation is resumed.

In the case where this defrosting operation is carried out, the high-pressure P2 refrigerant of the compressor 1 is directly supplied to the evaporator 7, so that there may occur a case where the inner pressure of the shell case 11 is higher than the discharge pressure P2 and thus the refrigerant lies up in the shell case 11, or a case where no vane back pressure of the compressor 1 is applied and thus so-called vane skipping occurs to induce abnormal sounds. The reason why the inner pressure of the shell case 11 is increased resides in that the excluded volume of the first stage of the compressor 1 is larger than the excluded volume of the second stage, or the resistance balance of the refrigerant circulating path is lost. If the refrigerant lies up in the shell case 11, the refrigerant circulation amount is short and thus sufficient defrosting cannot be performed.

Figure 2:
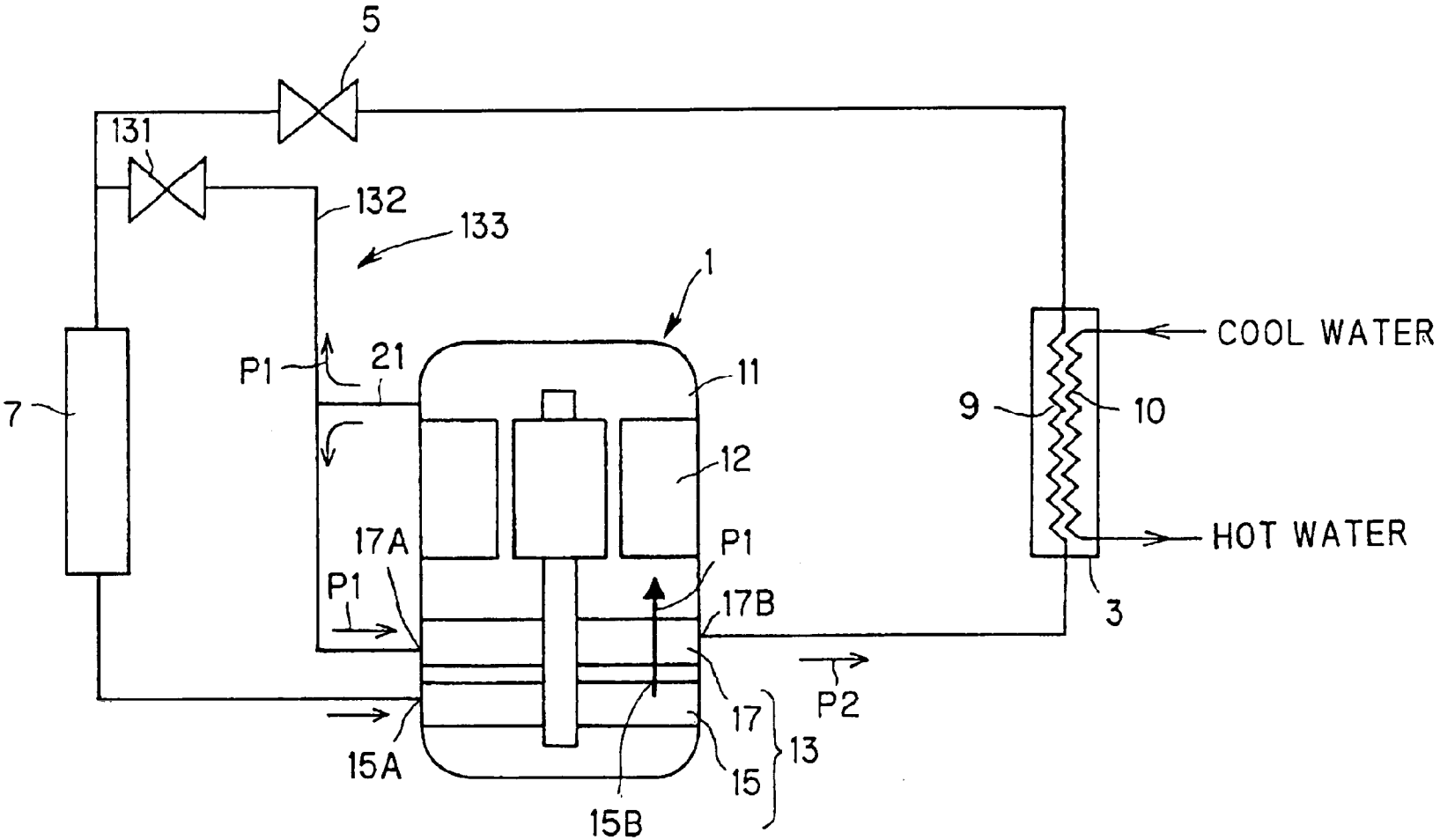
FIG. 2 is a circuit diagram showing another embodiment.

FIG. 2 shows another embodiment.

Therefore, this embodiment is equipped with a hot gas defrosting circuit 133 containing a defrosting electromagnetic valve 131 and a bypass pipe 132 to lead the intermediate pressure P1 refrigerant of the first stage 15 of the compressor 1 to the evaporator 7 with bypassing the gas cooler 3 and the pressure reducing device 5. In this defrosting operation, a normally-dosed defrosting electromagnetic valve 131 equipped in the bypass pipe 132 is opened.

In this case, since the refrigerant of the intermediate pressure P1 is lead to the evaporator 7, the inner pressure of the shell case 11 is never higher than the discharge pressure P2, and thus the pressure difference therebetween is reduced, so that the refrigerant is prevented from lying up in the shell case 11 or occurrence of abnormal sounds from the compressor 1 which are caused by vane skipping can be prevented.

Besides, in this type of compressor 1, the mixing ratio of refrigerating-machine oil contained in the refrigerant of the intermediate pressure P1 discharged from the first stage and the mixing ratio of refrigerating-machine oil contained in the refrigerant of the high-pressure P2 discharged from the second stage are different from each other. That is, the mixing ratio of the oil contained in the refrigerant of the intermediate pressure P1 is generally smaller than the mixing ratio of the oil contained in the refrigerant of the high pressure P2.

Therefore, according to this embodiment, the discharge amount of the oil in the defrosting operation is reduced and the residual oil amount in the shell case can be sufficiently secured as compared with the embodiment shown in FIG. 1, so that the durability of the compressor 1 can be enhanced.

Figure 3:
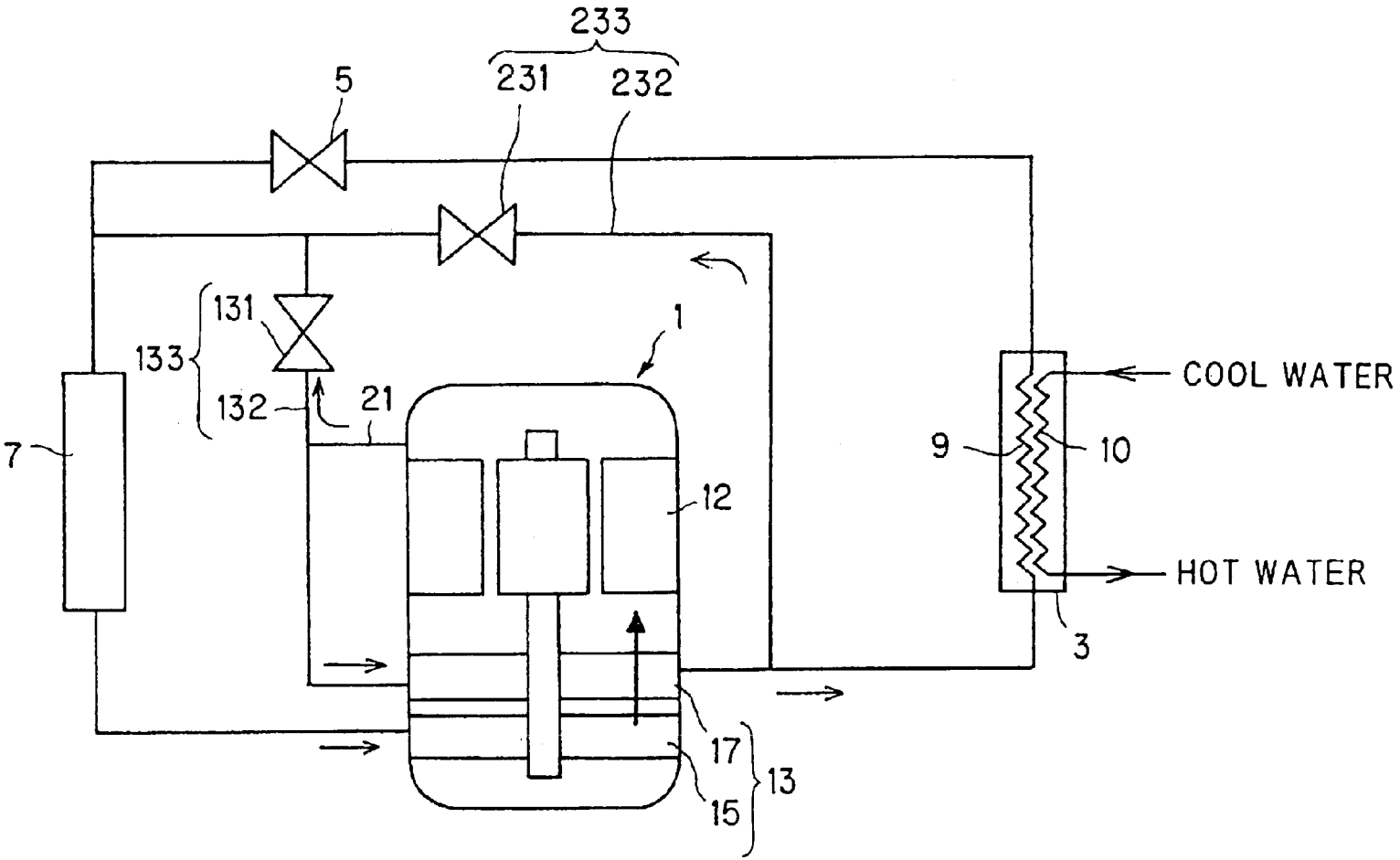
FIG. 3 is a circuit diagram showing another embodiment.

FIG. 3 shows another embodiment.

In addition to the defrosting circuit shown in FIG. 2, this embodiment is further provided with a hot gas defrosting circuit 233 containing a defrosting intermediate electromagnetic valve 231 and a bypass pipe 232 for leading the high-pressure P2 refrigerant of the second stage 17 of the compressor 1 to the evaporator 7 with bypassing the gas cooler 3 and the pressure reducing device 5. In this defrosting operation, both the normally-dosed defrosting electromagnetic valves 131, 231 are opened. This embodiment can achieve the same effect as the embodiment shown in FIG. 2.

When the heat pump apparatus as described above is fabricated, the inside of the shell case 11 of the compressor 1 which is set to the inner intermediate pressure is vacuum-evacuated, and then refrigerant is sealingly filled in the refrigerating cycle. When the shell case 11 is vacuum-evacuated, the vacuum-evacuation is carried out from any one or both of the suction port of the first stage and the discharge port of the second stage, however, in any case, the working is difficult.

In this embodiment, the defrosting intermediate electromagnetic valve 231 is provided in the bypass 232, and thus the vacuum-evacuation can be carried out from this site. Accordingly, the vacuum-evacuation of the inside of the shell case 11 is easily performed, the residual amount of impurity gas in the refrigerating cycle is reduced, deterioration of durability of the refrigerating-machine oil circulated in the refrigerating cycle is suppressed, and the durability of the compressor 1 can be enhanced.

Figure 4:
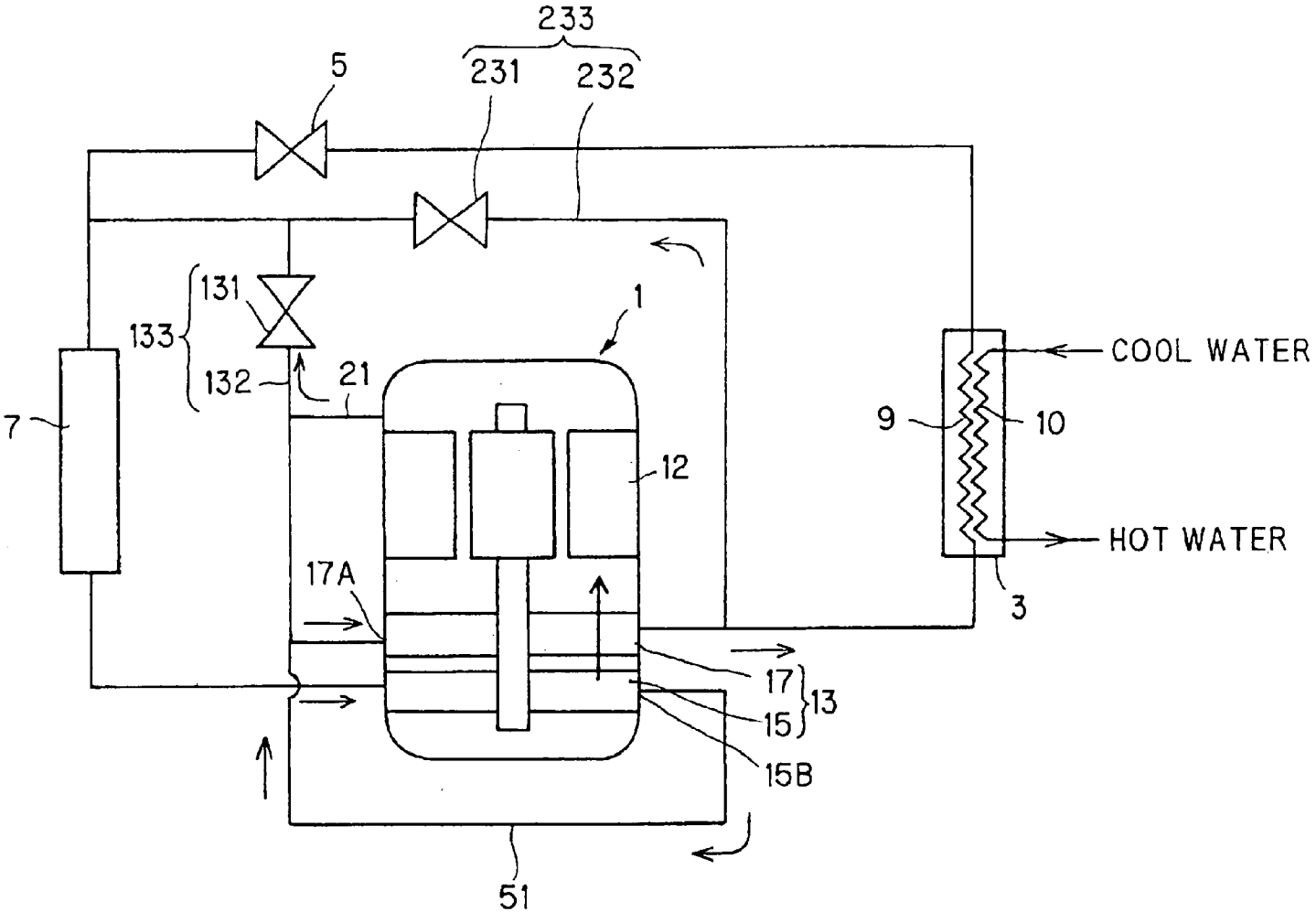
FIG. 4 is a circuit diagram showing another embodiment.

FIG. 4 shows another embodiment.

This embodiment has substantially the same construction as the embodiment shown in FIG. 3, and differs in the construction that not all, but a part of the refrigerant of the first stage of the compressor 1 is supplied into the shell case 11, and the remaining refrigerant is directly supplied from the discharge port 15B of the first stage through a pipe path 51 to the suction port 17A of the second stage. This construction can provide substantially the same effect as the embodiment as described above. The compressor of this embodiment may be applied to the defrosting circuit shown in FIG. 1, the defrosting circuit shown in FIG. 2, etc.

As described above, the present invention have been described on the basis of the embodiments, however, it is apparent that the present invention is not limited to these embodiments.

INDUSTRIAL APPLICABILITY

As described above, the present invention is suitably applied to a heat pump apparatus which can perform an efficient defrosting operation when an internal intermediate pressure two-stage compression type compressor is used.

What is claimed is:

1. A heat pump apparatus having a refrigerating cycle comprising:

a compressor, a gas cooler, a pressure reducing device, and an evaporator in which water can be heated by the gas cooler, wherein said compressor comprises a two-stage compression type rotary compressor having a shell case, an electric motor portion and a compressing portion driven by the electric motor portion, the electric motor portion and the compressing portion being accommodated in said shell case, and the compressor portion having a two-stage structure including a first-stage compressing portion and a second-stage compressing portion which are mounted in the shell case, wherein at least a part of refrigerant compressed to an intermediate pressure in the first-stage compressing portion is passed through said shell case to the second-stage compressing portion and compressed to a high pressure in the second-stage compressing portion, and the high-pressure refrigerant is discharged from the second-stage compressing portion to the outside of said shell case, and wherein said heat pump apparatus further comprises a defrosting circuit for leading the intermediate-pressure refrigerant from the first-stage compressing portion of said compressor to said evaporator with bypassing said gas cooler and said pressure reducing device.

2. The heat pump apparatus as claimed in claim 1, further including a high-pressure defrosting circuit for leading the high-pressure refrigerant of the second stage of said compressor to said evaporator while bypassing said gas cooler and said pressure reducing device.

3. The heat pump apparatus as claimed in claim 1, wherein refrigerant that works in a supercritical area at a high-pressure side is filled and used in the refrigerating cycle.

4. The heat pump apparatus as claimed in claim 1, wherein the refrigerant is $CO_2$ refrigerant.

5. The heat pump apparatus as claimed in claim 1, wherein said defrosting circuit is equipped with an opening/closing valve with which the inside of said shell case of said compressor can be vacuum-evacuated.

6. A heat pump apparatus having a refrigerating cycle including a compressor, a gas cooler, a pressure reducing device and an evaporator in which water can be heated by the gas cooler, wherein said compressor comprises a two-stage compressor for leading at least a part of refrigerant compressed to an intermediate pressure at a first stage through a shell case to a second stage, means for compressing the intermediate-pressure refrigerant to a high pressure at a second stage and discharging the high-pressure refrigerant, said heat pump apparatus further including a defrosting circuit for leading the intermediate-pressure refrigerant from the first stage of said compressor to said evaporator with bypassing said gas cooler and said pressure reducing device, and wherein the mixing ratio of oil in the intermediate-pressure refrigerant of the first stage is smaller than the mixing ratio of oil in the high-pressure refrigerant of the second stage.

7. A heat pump apparatus having a refrigerating cycle comprises:

a compressor, a gas cooler, a pressure reducing device, and an evaporator in which water can be heated by the gas cooler, wherein said compressor comprises a two-stage compression type rotary compressor having a shell case, an electric motor portion and a compressing portion driven by the electric motor portion, the electric motor portion and the compressing portion being accommodated in said shell case, and the compressor portion having a two-stage structure including a first-stage compressing portion and a second-stage compressing portion which are mounted in the shell case, wherein at least a part of refrigerant compressed to an intermediate pressure in the first-stage compressing portion is passed through said shell case to the second-stage compressing portion and compressed to a high pressure in the second-stage compressing portion, and the high-pressure refrigerant is discharged from the second-stage compressing portion to the outside of said shell case, and wherein said heat pump apparatus further comprises a defrosting circuit for selectively leading at least one of the intermediate-pressure refrigerant of the first-stage of said compressor and the high-pressure refrigerant of the second-stage to said evaporator while bypassing said gas cooler and said pressure reducing device.

8. The heat pump apparatus as claimed in claim 7, wherein the refrigerant is $CO_2$ refrigerant.

9. The heat pump apparatus as claimed in claim 7, wherein said defrosting circuit is equipped with an opening/closing valve with which the inside of said shell case of said compressor can be vacuum-evacuated.

10. A heat pump apparatus having a refrigerating cycle including a compressor, a gas cooler, a pressure reducing device and an evaporator in which water can be heated by the gas cooler, wherein refrigerant that works in a supercritical area at a high pressure side is filled and used in said refrigerating cycle, said compressor having a shell case comprises a two-stage compressor for leading at least a part of refrigerant compressed to an intermediate pressure at a first stage through said shell case to a second stage, means for compressing the intermediate-pressure refrigerant to a high pressure at the second stage and discharging the high-pressure refrigerant, said heat pump apparatus further including a defrosting circuit for selectively leading at least one of the intermediate-pressure refrigerant of the first stage of said compressor and the high pressure refrigerant of the second stage to said evaporator while bypassing said gas cooler and said pressure reducing device, and wherein the mixing ratio of oil in the intermediate-pressure refrigerant of the first stage is smaller than the mixing ratio of oil in the high-pressure refrigerant of the second stage.

* * * * *